US010239744B2

(12) United States Patent
Mei et al.

(10) Patent No.: US 10,239,744 B2
(45) Date of Patent: Mar. 26, 2019

(54) FLUID FEEDING DEVICE

(71) Applicants: Longyuan Mei, Lexington, MA (US); Longzhi Mei, Ontario (CA); Longyu Mei, Lexington, MA (US)

(72) Inventors: Longyuan Mei, Lexington, MA (US); Longzhi Mei, Ontario (CA); Longyu Mei, Lexington, MA (US)

( * ) Notice: Subject to any disclaimer, the term of this patent is extended or adjusted under 35 U.S.C. 154(b) by 240 days.

(21) Appl. No.: 15/240,599

(22) Filed: Aug. 18, 2016

(65) Prior Publication Data

US 2017/0050839 A1 Feb. 23, 2017

Related U.S. Application Data

(60) Provisional application No. 62/206,303, filed on Aug. 18, 2015.

(51) Int. Cl.
*B67D 7/02* (2010.01)
*B67D 7/58* (2010.01)

(52) U.S. Cl.
CPC ..... *B67D 7/0255* (2013.01); *B67D 7/58* (2013.01)

(58) Field of Classification Search
CPC ..... B67D 7/0255; B67D 7/58
See application file for complete search history.

(56) References Cited

U.S. PATENT DOCUMENTS 9,731,954 B2 * 8/2017 Blackburn ..... B67D 1/0004

* cited by examiner

*Primary Examiner* — Jason K Niesz

(57) ABSTRACT

A fluid feeding device utilizes one or more fluid driving devices to cause pressure changes in an outer container of one or more fluid transfer units to change the pressure in a fluid delivery inner container within the outer container in order to expel or intake a transmitted fluid from or into the inner container, exempting the fluid feeding device from directly contacting the transmitted fluid.

23 Claims, 8 Drawing Sheets

FLUID FEEDING DEVICE

The current application claims a priority to the U.S. Provisional Patent application Ser. No. 62/206,303 filed on Aug. 18, 2015.

FIELD OF THE INVENTION

The present invention relates to a material transfer device, particularly to a fluid feeding device.

BACKGROUND OF THE INVENTION

At present, various atmospheric-pressure or pressurizing fluid feeding devices respectively use different pumps outputting different pressures. Conventionally, the transmitted fluid spontaneously flows into the pump or is sucked into the pump, then pressurized and output to the material receiving system by the pump. However, such a feeding device has the following disadvantages. Firstly, as the transmitted material directly contacts the pump, the related parts of the pump requires special materials; however, the selected material is hard to simultaneously satisfy the functional requirement of the pump and the requirements for preventing the pump material from polluting the transmitted fluid, preventing the transmitted fluid from corroding the pump, and preventing the transmitted fluid from loss. Secondly, even though the problem of material selection is solved, different transmitted materials normally demand their dedicated pumps so as to avoid mutual pollution, spending time in washing the pumps, and processing the waste water generated in washing the pumps; thus is increased the investment to the apparatuses and the cost to operate and maintain the apparatuses. For example, while different materials are added to the reactor in industry or laboratories, it is hard to find a material simultaneously satisfying the requirements for the performance of the pump and the materials transmitted by the pump; normally, different materials are respectively transmitted by different pumps. In medicine, an injection pump is used to infuse fluid into the patient; limited by the volume of the injection pump, the injection pump may be replaced several times, which increases the cost of administration and the probability of pollution. In laboratories, an injection pump is sometimes used to provide a high-pressure liquid to a high-pressure liquid chromatograph in a stable flow rate; because of directly contacting the liquid, the pump requires special pump material and pump structure; besides, the pump is hard to be cleaned thoroughly before the injected liquid is to be changed. Therefore, the existing technology cannot satisfy requirement. Hence, the present invention provides a fluid feeding device to solve the problems of the existing technology.

DETAIL DESCRIPTIONS OF THE INVENTION

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced without the implementation of some features as they are described. It should be understood that some details have not been described in detail in order to not unnecessarily obscure focus of the invention.

Figure 1:
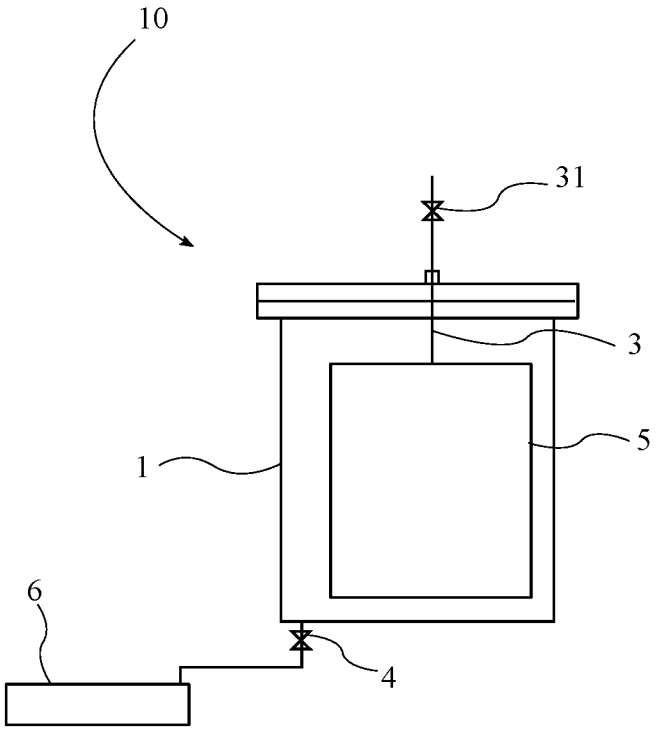
FIG. 1 is a diagram schematically showing one embodiment of the fluid transfer unit of the present invention.

The present invention is a fluid feeding device which can transfer fluid without contacting the transmitted fluid with a pump or other working parts of the device. Referring to FIG. 1, the preferred embodiment of the present invention generally comprises at least one fluid driving device 6 and at least one fluid transfer unit 10. The fluid transfer unit 10 comprises an outer container 1, at least one fluid delivery inner container 5, at least one fluid transfer pipe 3, and at least one pressurizing-fluid pipe 4. It should be understood that various components herein discussed may be comprised as a singular component or multiple instances of the same component. Components which may be duplicated in various embodiments will be referred to herein as singular components for convenience of generality.

The fluid delivery inner container 5 is positioned within the outer container 1. The fluid transfer pipe 3 is connected with the fluid delivery inner container 5 and traverses through the outer container 1. The pressurizing-fluid pipe 4 is interconnected between the fluid driving device 6 and the outer container 1. The outer container 1 is sealed. In one embodiment, the outer container 1 is a rigid container. In one embodiment, the outer container 1 has variable volume. The fluid delivery inner container 5 is also sealed, and has variable volume. In one embodiment, the fluid delivery inner container 5 has a multilayer structure such as, but not limited to, aluminum foil composite film or polyethylene terephthalate (PET)/aluminum/polyethylene(PE) film. The fluid delivery inner container 5 may be made from any desired and useful material that facilitates the functionality of the present invention.

The present invention works by applying or removing pressure within the outer container 1 with the fluid driving device 6, compressing or expanding the fluid delivery inner container 5, and thus transmitting fluid from or into the fluid delivery inner container 5 through the fluid transfer pipe 3. Thus, the fluid driving device 6 never comes into contact with the fluid to be transmitted into or out of the fluid delivery inner container 5. In some embodiments, the fluid transfer pipe 3 is interconnected between the fluid delivery inner container 5 and at least one material storage container 72.

It should be noted that definitions of "one embodiment" may apply to any embodiment where the definition of said embodiment applies. Definitions of various embodiments herein may apply only to certain portions of the present invention, and the present invention as a whole may be defined through combinations of various said embodiments.

Figure 2:
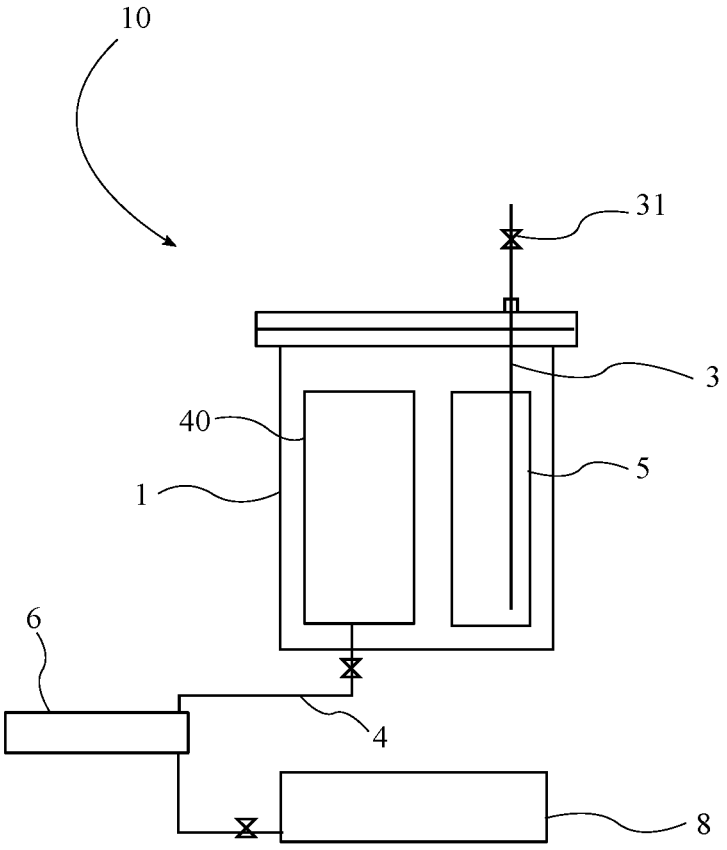
FIG. 2 is a diagram schematically showing another embodiment of the fluid transfer unit of the present invention.

Referring to FIG. 2, in one embodiment, at least one fluid transfer unit 10 comprises at least one pressurizing inner container 40. The pressurizing inner container 40 is positioned within the outer container 1, and the pressurizing-fluid pipe 4 is interconnected between the fluid driving device 6 and the pressurizing inner container 40, passing through the outer container 1 to reach the pressurizing inner container 40. In one embodiment, the pressurizing inner container 40 is a sealed volume-variable container. In one embodiment, the pressurizing inner container 40 has a multilayer structure. Use of the pressurizing inner container 40 is simply an alternate method of pressurizing the outer container 1. The fluid driving device 6 drives fluid into the pressurizing inner container 40, pressurizing and expanding the pressurizing inner container 40 and thus applying a pressure to the fluid delivery inner container 5 in order to expel transmitted fluid from the fluid delivery inner container 5. The reverse process is executed in order to draw fluid into the fluid delivery inner container 5.

In one embodiment, the fluid transfer unit 10 further comprises a pressure adjustment pipe 2 and a pressure adjustment valve 20. The pressure adjustment pipe 2 is connected to the outer container 1, and the pressure adjustment valve 20 is operatively connected with the pressure adjustment pipe 2. The pressure adjustment pipe 2 and the pressure adjustment valve 20 allow pressure to be relieved from the outer container 1; for example, by letting air escape from the outer container 1.

In one embodiment, a pressurizing fluid storage container 71 and a pressurizing fluid reservoir 8 are further comprised. The pressure adjustment pipe 2 is thus interconnected between the outer container 1 and the pressurizing fluid storage container 71, and the pressure adjustment valve 20 is operatively connected to the pressure adjustment pipe 2 between the outer container 1 and the pressurizing fluid storage container 71. The pressurizing fluid reservoir 8 is interconnected with the fluid driving device 6. The pressure adjustment pipe 2, pressure adjustment valve 20, pressurizing fluid storage container 71, and pressurizing fluid reservoir 8 are not essential in all cases, but may be essential in some cases depending on the specific type of fluid driving device 6, such as if the fluid driving device 6 itself has no fluid holding capacity and must intake from and discharge into other containers simultaneously.

Figure 3:
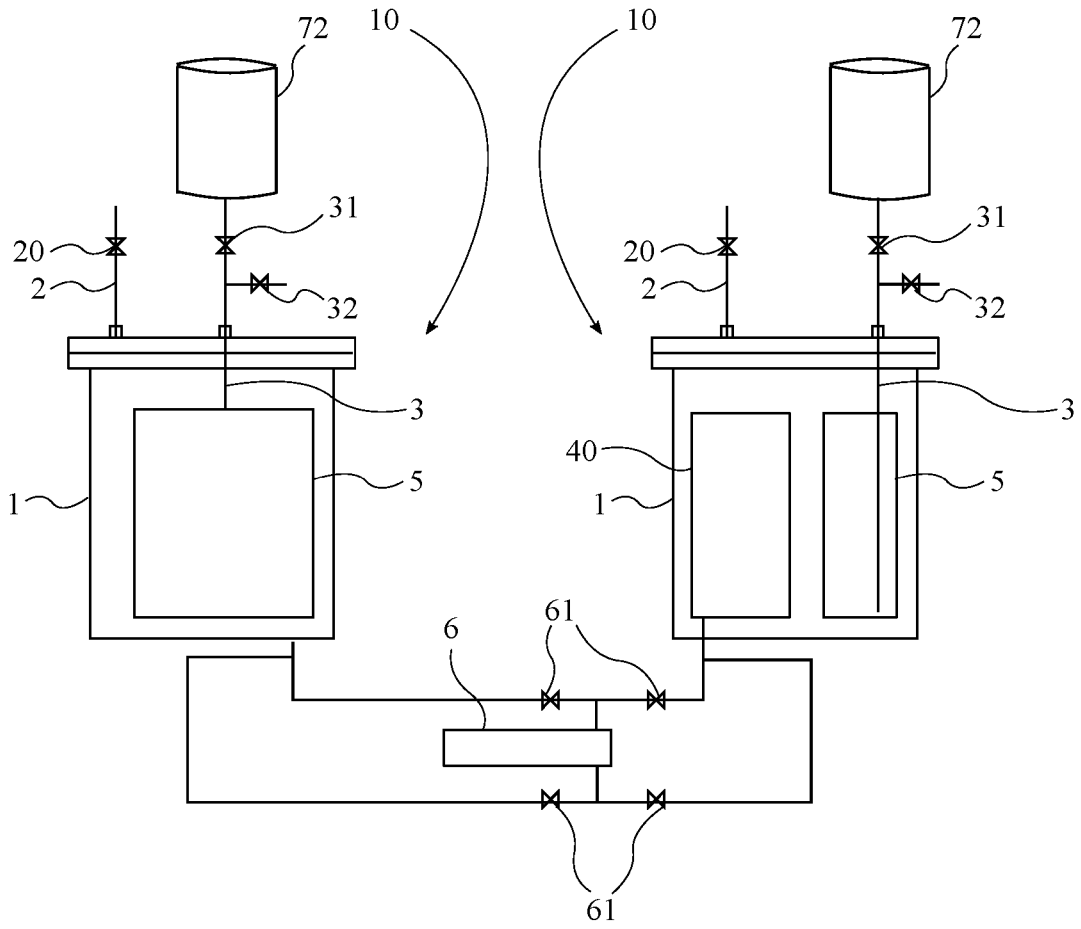
FIG. 3 is a diagram schematically showing one embodiment of the present invention with two fluid transfer units.

Referring to FIG. 3, in one embodiment, multiple fluid feeding units are operated by one fluid driving device 6. More particularly, the at least one fluid transfer unit 10 comprises a plurality of fluid transfer units 10, and the at least one fluid driving devices 6 comprises a single fluid driving device 6. An inlet and an outlet of the single fluid driving device 6 are interconnected with the outer container 1 of each of the plurality of fluid transfer units 10. A plurality of valves 61 of the pressurizing-fluid pipe 4 are operatively engaged between the single fluid driving device 6 and the outer containers 1 of the fluid transfer units 10, wherein a fluid flow direction among the plurality of fluid transfer units 10 through the pressurizing-fluid pipe 4 is controlled through proper operation of the valves 61. One or more pressurizing-fluid pipes 4 may be connected together in a pressurizing-fluid piping system in this embodiment to facilitate proper fluid communication between the fluid driving device 6 and the fluid feeding units.

In one embodiment, similar to the preceding embodiment, a plurality of fluid transfer units 10 are operated by a single fluid driving device 6. However, in this embodiment, at least one of the plurality of fluid transfer units 10 comprises a at least one pressurizing inner container 40, and the inlet and outlet of the single fluid driving device 6 are interconnected with the pressurizing inner container 40 of each of the plurality of fluid transfer units 10. This embodiment pressurizes the outer containers 1 of the fluid transfer units 10 by pressurizing the pressurizing inner containers 40 as opposed to directly pressurizing the outer containers 1. Embodiments combining the use and omission of the pressurizing inner container 40 in separate fluid transfer units 10 may be utilized, such as the embodiment shown in FIG. 3.

Figure 4:
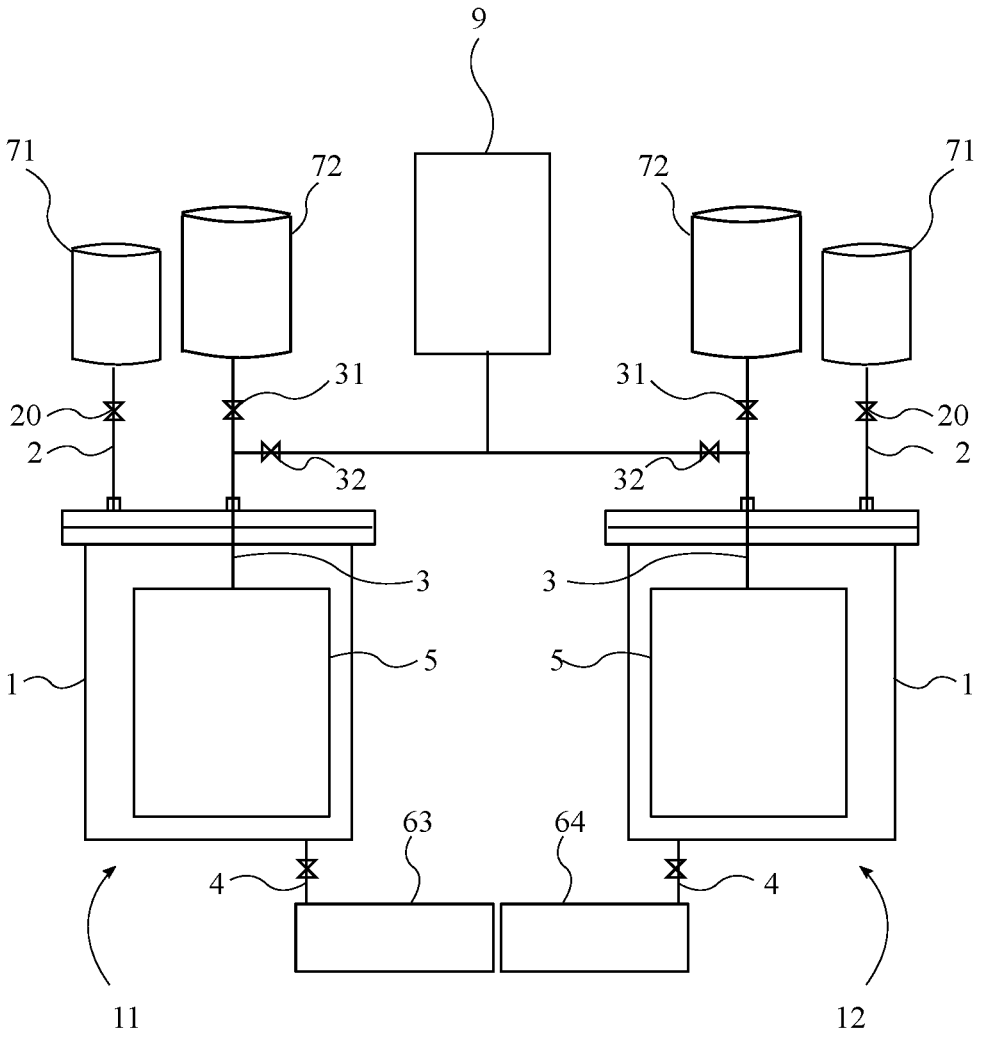
FIG. 4 is a diagram schematically showing one embodiment of the present invention with two fluid transfer units interconnected with a transmitted material storage container.

Referring to FIG. 4, one embodiment further comprises a transmitted fluid receiver 9, and the fluid transfer unit 10 further comprises a transmitted fluid outlet piping-valve system 32. The fluid delivery inner container 5 is interconnected with the transmitted fluid receiver 9 through the transmitted fluid outlet piping-valve system 32.

In one embodiment, the fluid transfer unit 10 further comprises a material storage container 72 and a transmitted fluid supply piping-valve system 31. The fluid delivery inner container 5 is interconnected with the material storage container 72 through the transmitted fluid supply piping-valve system 31.

In one embodiment shown in FIG. 4 further comprising a transmitted fluid receiver 9, the fluid transfer unit 10 comprises a first fluid transfer unit 11 and a second fluid transfer unit 12, and the at least one fluid driving device 6 comprises a first fluid driving device 63 and a second fluid driving device 64. The first fluid driving device 63 is interconnected with the outer container 1 of the first fluid transfer unit 11, and the second driving device is interconnected with the outer container 1 of the second fluid transfer unit 12. The first fluid transfer unit 11 and the second fluid transfer unit 12 each further comprise a material storage container 72, a transmitted fluid supply piping-valve system 31 and a transmitted fluid outlet piping-valve system 32. The fluid delivery inner container 5 is interconnected with the material storage container 72 through the transmitted fluid supply piping-valve system 31 for each of the first fluid transfer unit 11 and the second fluid transfer unit 12. The fluid delivery container is further interconnected with the transmitted fluid receiver 9 through the transmitted fluid outlet piping-valve system 32 for each of the first fluid transfer unit 11 and the second fluid transfer unit 12. The first fluid transfer unit 11 and the second fluid transfer unit 12 respectively and alternatingly work in opposite states to cyclically change a flow direction of a transmitted fluid between the fluid delivery inner containers 5 and the transmitted fluid receiver 9.

In one embodiment, similar to the preceding embodiment, the first fluid transfer unit 11 and the second fluid transfer unit 12 each comprise a pressurizing inner container 40. The first fluid driving device 63 is interconnected with the pressurizing inner container 40 of the first fluid transfer unit 11, and the second fluid driving device 64 is interconnected with the pressurizing inner container 40 of the second fluid transfer unit 12.

In all embodiments of the present invention, the fluid driving device 6 may be any device which is capable of moving fluid in order to increase or decrease pressure within the outer container 1 in order to increase or decrease pressure within the fluid delivery inner container 5 to achieve the desired result of fluid being expelled from or drawn into the fluid delivery inner container 5.

In one embodiment, the fluid driving device 6 is a pump assembly including a pump, wherein the flow rate and pressure of the pump assembly can be controlled to specific values, and wherein the pump simultaneously intakes a fluid into an inlet of the pump and outputs the fluid from an outlet of the pump.

Figure 5:
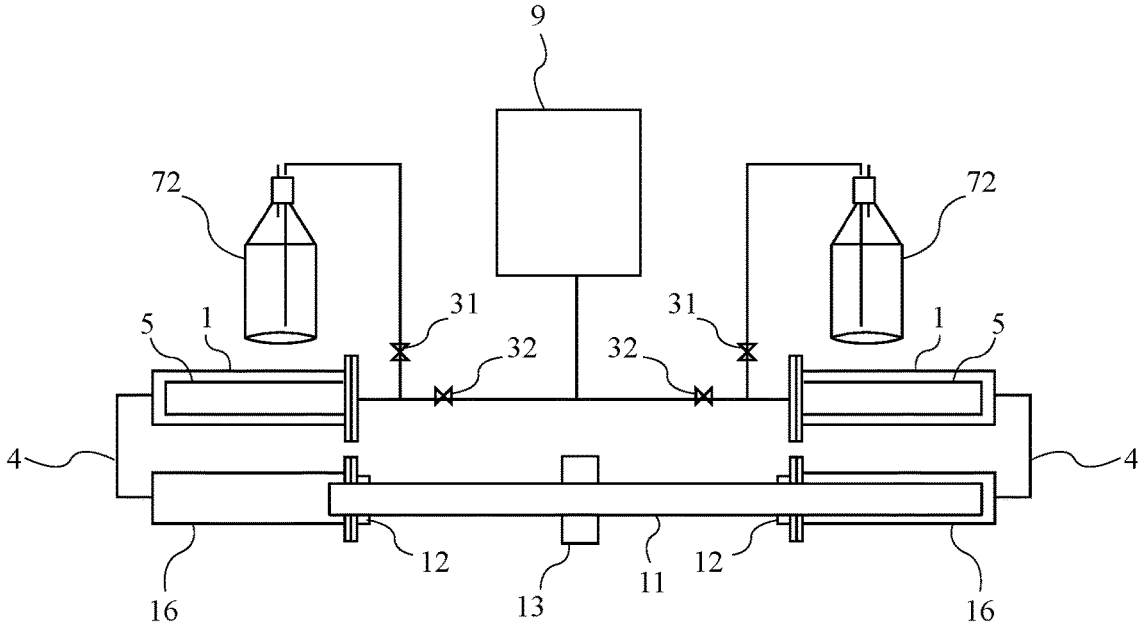
FIG. 5 is a diagram schematically showing one embodiment of the present invention with two fluid transfer units and a fluid driving device with a piston rod and a pair of fluid chambers.

In one embodiment shown in FIG. 5, the fluid driving device 6 comprises a pair of fluid chambers 16, a piston rod 11, a pair of sealing devices 12, and a driving member 13. The extremities of the piston rod 11 are disposed within the pair of fluid chambers 16, wherein the pair of fluid chamber are positioned opposite each other along the piston rod 11. The pair of sealing devices 12 is connected to the pair of fluid chambers 16 around the piston rod 11, wherein the pair of sealing devices 12 seals the extremities of the piston rod 11 within the pair of fluid chambers 16. The driving member 13 is operatively connected to the piston rod 11, wherein the driving member 13 actuates the piston rod 11 to move reciprocatingly within the fluid chamber in order to alternatingly expel fluid from and intake fluid into the fluid chambers 16. Each of the pair of fluid chambers 16 is interconnected with the outer containers 1 of a respective fluid transfer unit 10 from the at least one fluid transfer unit 10 through a respective pressurizing-fluid pipe 4.

Figure 6:
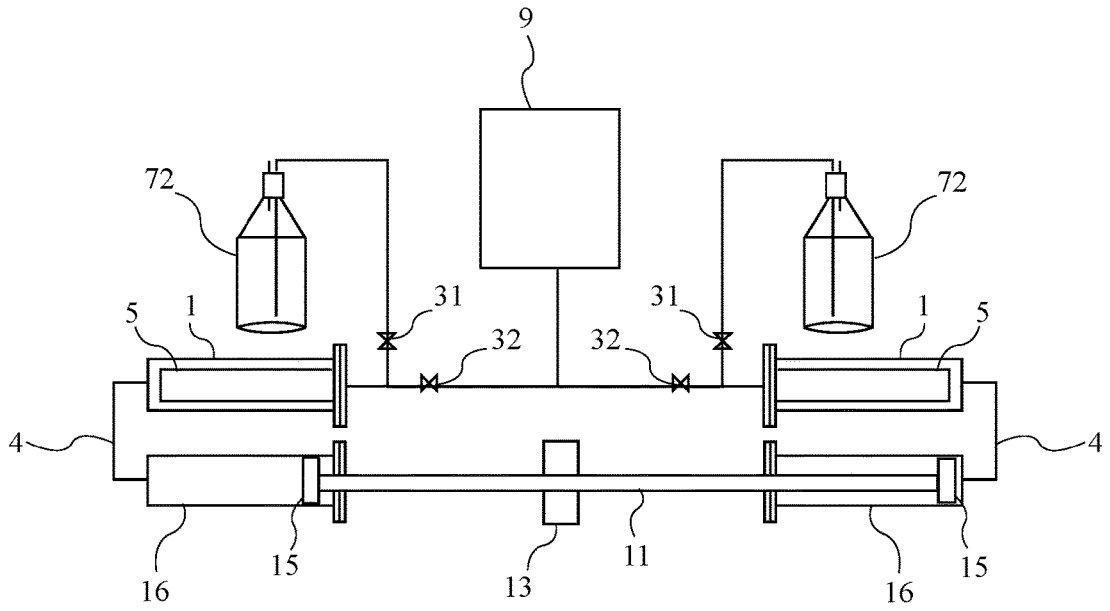
FIG. 6 is a diagram schematically showing another embodiment of the present invention with two fluid transfer units and a fluid driving device with a piston rod and a pair of fluid chambers.

In one embodiment shown in FIG. 6, the fluid driving device 6 comprises a pair of fluid chambers 16, a piston rod 11, a pair of pistons 15, and a driving member 13. The pair of pistons 15 is disposed at opposite extremities of the piston rod 11, and the pair of pistons 15 is internally sealed against the lateral walls of the fluid chambers 16. The driving member 13 is operatively connected to the piston rod 11, wherein the driving member 13 actuates the piston rod 11 to move reciprocatingly within the fluid chambers 16 in order to alternatingly expel fluid from and intake fluid into the fluid chambers 16. Each of the pair of fluid chambers 16 is interconnected with the outer container 1 of a respective fluid transfer unit 10 from the at least one fluid transfer unit 10 through a respective pressurizing-fluid pipe 4 from the at least one pressurizing-fluid pipe 4.

Figure 7:
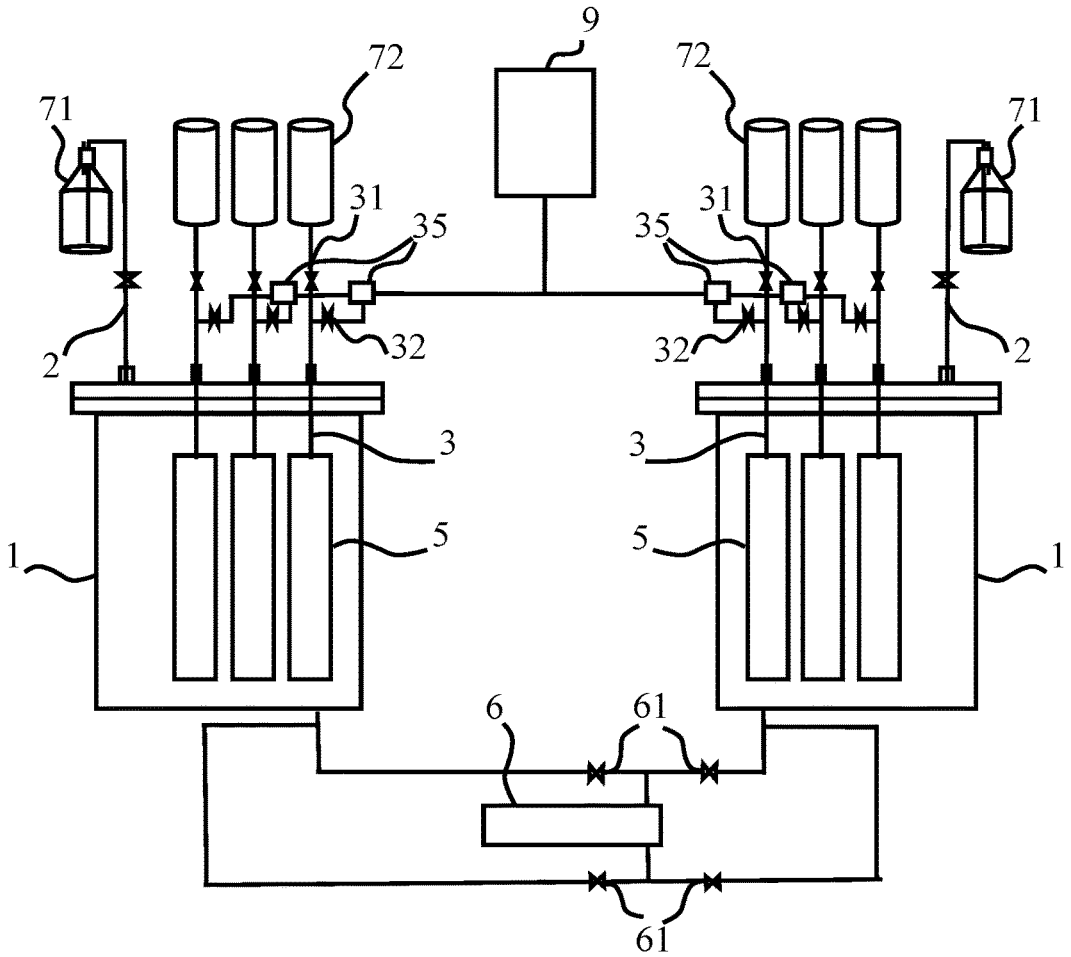
FIG. 7 is a diagram schematically showing one embodiment of the present invention with two fluid transfer units, each with multiple fluid delivery inner containers and material storage containers.

Referring to FIG. 7, in one embodiment comprising a transmitted fluid receiver 9, the fluid transfer unit 10 comprises a plurality of fluid delivery inner containers 5, a plurality of material storage containers 72, a plurality of transmitted fluid supply piping-valve systems 31, a plurality of transmitted fluid outlet piping-valve systems 32, and at least one flow ratio controller 35. Each of the fluid delivery inner containers 5 is interconnected with one of the material storage containers 72 through one of the transmitted fluid supply piping-valve systems 31. Each of the fluid delivery inner containers 5 is also interconnected with one of the flow ratio controllers 35 through one of the transmitted fluid outlet piping-valve systems 32. Each of the transmitted fluid outlet piping-valve system 32 is interconnected with the transmitted fluid receiver 9 through at least one of the flow ratio controllers 35.

Figure 8:
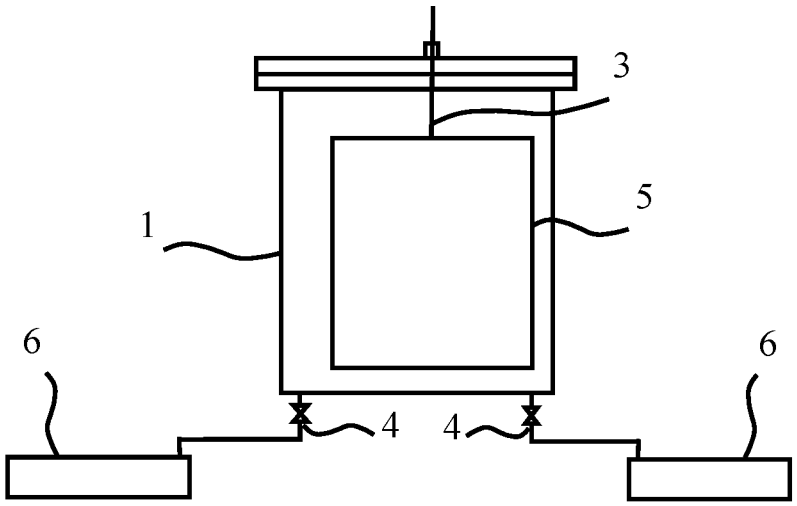
FIG. 8 is a diagram schematically showing one embodiment of the present invention with multiple fluid driving devices.

Referring to FIG. 8, in one embodiment, the at least one fluid driving device 6 comprises a plurality of fluid driving devices 6, and the at least one pressurizing-fluid pipe 4 comprises a plurality of pressurizing-fluid pipes 4. In said embodiment, each of the fluid driving devices 6 is interconnected with the outer container 1 through one of the pressurizing-fluid pipes 4. It is noted that generally, the quantity of fluid driving devices 6 is not of critical importance to the operation of the present invention, so long as the outer container 1 of each fluid transfer unit 10 is able to be pressurized through at least one fluid driving device 6, though multiple fluid driving devices 6 may be desirable in various embodiments.

In comparison with the conventional technology, the fluid feeding device of the present invention has the following advantages: the fluid feeding device is exempted from directly contacting the transmitted fluid and uses a driving device to compress a pressuring fluid to replace the same amount of transmitted fluid. As the transmitted fluid does not directly contact the parts of the driving unit, the probability of pollution is decreased. The selection of the material of the driving mechanism is irrespective of the transmitted fluid but only dependent on the functional requirement of the driving mechanism itself, whereby the limitation to the design of the driving mechanism is significantly reduced and the performance of the fluid feeding device greatly increased. The fluid feeding device of the present invention can apply to high-pressure liquid chromatography, medical fluid transmission and infusion, fluid material transportation in chemical reactors, etc. The fluid feeding device of the present invention also features simple structure and high utility.

Although the invention has been explained in relation to its preferred embodiment, it is to be understood that many other possible modifications and variations can be made without departing from the spirit and scope of the invention as hereinafter claimed.

What is claimed is:

1. A fluid feeding device comprises:

at least one fluid driving device;

at least one fluid transfer unit, each fluid transfer unit comprising an outer container, at least one fluid delivery inner container, at least one fluid transfer pipe, and at least one pressurizing-fluid pipe;

the fluid delivery inner container being positioned within the outer container;

the fluid transfer pipe being connected with the fluid delivery inner container and traversing through the outer container;

the pressurizing-fluid pipe being interconnected between the fluid driving device and the outer container;

the outer container being sealed;

the fluid delivery inner container being sealed and having variable volume;

the fluid transfer unit further comprises a pressure adjustment pipe and a pressure adjustment valve;

the pressure adjustment pipe being connected to the outer container; and the pressure adjustment valve being operatively connected with the pressure adjustment pipe.

2. The fluid feeding device as claimed in claim 1 comprises:

the fluid transfer pipe being interconnected between the fluid delivery inner container and at least one material storage container.

3. The fluid feeding device as claimed in claim 1 comprises:

a pressurizing fluid reservoir; and the pressurizing fluid reservoir being interconnected with the fluid driving device.

4. The fluid feeding device as claimed in claim 1 comprises:

a pressurizing fluid storage container;

the pressure adjustment pipe being interconnected between the outer container and the pressurizing fluid storage container; and the pressure adjustment valve being operatively connected to the pressure adjustment pipe between the outer container and the pressurizing fluid storage container.

5. The fluid feeding device as claimed in claim 1 comprises:

the at least one fluid driving device comprises a plurality of fluid driving devices;

the at least one pressurizing-fluid pipe comprises a plurality of pressurizing-fluid pipes; and each of the fluid driving devices being interconnected with the outer container through one of the pressurizing-fluid pipes.

6. The fluid feeding device as claimed in claim 1 comprises:

at least one fluid transfer unit further comprises at least one pressurizing inner container;

the pressurizing inner container being positioned within the outer container; and the pressurizing-fluid pipe being interconnected between the fluid driving device and the pressurizing inner container.

7. The fluid feeding device as claimed in claim 1 comprises:

the at least one fluid transfer unit comprises a plurality of fluid transfer units;

the at least one fluid driving device comprises a single fluid driving device;

an inlet and an outlet of the single fluid driving device being interconnected with the outer container of each of the plurality of fluid transfer units; and a plurality of valves of the pressurizing-fluid pipe being operatively engaged between the single fluid driving device and the outer containers of the fluid transfer units, wherein a fluid flow direction among the plurality of fluid transfer units through the pressurizing-fluid pipe is controlled through proper operation of the valves.

8. The fluid feeding device as claimed in claim 1 comprises:

the at least one fluid transfer unit comprises a plurality of fluid transfer units;

the at least one fluid driving device comprises a single fluid driving device;

an inlet and an outlet of the single fluid driving device being interconnected with at least one pressurizing inner container of at least one of the plurality of fluid transfer units; and a plurality of valves of the pressurizing-fluid pipe being operatively engaged between the single fluid driving device and the pressurizing inner containers of the fluid transfer units, wherein a fluid flow direction among the plurality of fluid transfer units through the pressurizing-fluid pipe is controlled through proper operation of the valves.

9. The fluid feeding device as claimed in claim 1 comprises:

the at least one fluid transfer unit comprises a plurality of fluid transfer units;

the at least one fluid driving device comprises a single fluid driving device;

an inlet and an outlet of the single fluid driving device being interconnected with at least one pressurizing inner container of at least one of the plurality of fluid transfer units and with the outer container of at least one of the plurality of fluid transfer units; and a plurality of valves of the pressurizing-fluid pipe being operatively engaged between the single fluid driving device and the outer containers of the fluid transfer units, wherein a fluid flow direction among the plurality of fluid transfer units through the pressurizing-fluid pipe is controlled through proper operation of the valves.

10. The fluid feeding device as claimed in claim 1 comprises:

a transmitted fluid receiver;

the fluid transfer unit further comprises a transmitted fluid outlet piping-valve system; and the fluid delivery inner container being interconnected with the transmitted fluid receiver through the transmitted fluid outlet piping-valve system.

11. The fluid feeding device as claimed in claim 1 comprises:

the fluid transfer unit further comprises a material storage container and a transmitted fluid supply piping-valve system; and the fluid delivery inner container being interconnected with the material storage container through the transmitted fluid supply piping-valve system.

12. The fluid feeding device as claimed in claim 1 comprises:

a transmitted fluid receiver;

the at least one fluid transfer unit comprises a first fluid transfer unit and a second fluid transfer unit;

the at least one fluid driving device comprises a first fluid driving device and a second fluid driving device;

the first fluid driving device being interconnected with the outer container of the first fluid transfer unit;

the second fluid driving device being interconnected with the outer container of the second fluid transfer unit;

the first fluid transfer unit and the second fluid transfer unit each further comprise a material storage container, a transmitted fluid supply piping-valve system and a transmitted fluid outlet piping-valve system;

the fluid delivery inner container being interconnected with the material storage container through the transmitted fluid supply piping-valve system for each of the first fluid transfer unit and the second fluid transfer unit; and the fluid delivery inner container being interconnected with the transmitted fluid receiver through the transmitted fluid outlet piping-valve system for each of the first fluid transfer unit and the second fluid transfer unit, wherein the first fluid transfer unit and the second fluid transfer unit respectively alternatingly work in opposite states to cyclically change a flow direction of a transmitted fluid between the fluid delivery inner containers and the transmitted fluid receiver.

13. The fluid feeding device as claimed in claim 1 comprises:

a transmitted fluid receiver;

the at least one fluid transfer unit comprises a first fluid transfer unit and a second fluid transfer unit;

the at least one fluid driving device comprises a first fluid driving device and a second fluid driving device;

the first fluid driving device being interconnected with a pressurizing inner container of the first fluid transfer unit;

the second fluid driving device being interconnected with a pressurizing inner container of the second feeding unit;

the first fluid transfer unit and the second fluid transfer unit each further comprise a material storage container, a transmitted fluid supply piping-valve system and a transmitted fluid outlet piping-valve system;

the fluid delivery inner container being interconnected with the material storage container through the transmitted fluid supply piping-valve system for each of the first fluid transfer unit and the second feeding unit; and the fluid delivery inner container being interconnected with the transmitted fluid receiver through the transmitted fluid outlet piping-valve system for each of the first fluid transfer unit and the second fluid transfer unit, wherein the first fluid transfer unit and the second fluid transfer unit respectively alternatingly work in opposite states to cyclically change a flow direction of a transmitted fluid between the fluid delivery inner containers and the transmitted fluid receiver.

14. The fluid feeding device as claimed in claim 1 comprises:

the outer container being a rigid container.

15. The fluid feeding device as claimed in claim 1 comprises:

the outer container having variable volume.

16. The fluid feeding device as claimed in claim 1 comprises:

the fluid delivery inner container being a sealed volume-variable container.

17. The fluid feeding device as claimed in claim 1 comprises:

the fluid delivery inner container having a multilayer structure.

18. The fluid feeding device as claimed in claim 1 comprises:

a pressurizing inner container of the fluid transfer unit being a sealed volume-variable container.

19. The fluid feeding device as claimed in claim 1 comprises:

a pressurizing inner container of the fluid transfer unit having a multilayer structure.

20. The fluid feeding device as claimed in claim 1 comprises:

the fluid driving device being a pump assembly including a pump, wherein the flow rate and pressure of the pump assembly can be controlled to specific values, and wherein the pump simultaneously intakes a fluid into an inlet of the pump and outputs the fluid from an outlet of the pump.

21. The fluid feeding device as claimed in claim 1 comprises:

the fluid driving device comprising a pair of fluid chambers, a piston rod, a pair of sealing devices, and a driving member;

the extremities of the piston rod being disposed within the pair of fluid chambers, wherein the pair of fluid chambers are positioned opposite each other along the piston rod;

the pair of sealing devices being connected to the pair of fluid chambers around the piston rod, wherein the pair of sealing devices seals the extremities of the piston rod within the pair of fluid chambers;

the driving member being operatively connected to the piston rod, wherein the driving member actuates the piston rod to move reciprocatingly within the fluid chambers in order to alternatingly expel fluid from and intake fluid into the fluid chambers; and each of the pair of fluid chambers being interconnected with the outer container of a respective fluid transfer unit from the at least one fluid transfer unit through a respective pressurizing-fluid pipe from the at least one pressurizing-fluid pipe.

22. The fluid feeding device as claimed in claim 1 comprises:

the fluid driving device comprising a pair of fluid chambers, a piston rod, a pair of pistons, and a driving member;

the pair of pistons being disposed at opposite extremities of the piston rod;

the pair of pistons being internally sealed against the lateral walls of the fluid chambers;

the driving member being operatively connected to the piston rod, wherein the driving member actuates the piston rod to move the pistons reciprocatingly within the fluid chambers in order to alternatingly expel fluid from and intake fluid into the fluid chambers; and each of the pair of fluid chambers being interconnected with the outer container of a respective fluid transfer unit from the at least one fluid transfer unit through a respective pressurizing-fluid pipe from the at least one pressurizing-fluid pipe.

23. The fluid feeding device as claimed in claim 1 comprises:

a transmitted fluid receiver;

the fluid transfer unit further comprises a plurality of fluid delivery inner containers, a plurality of material storage containers, a plurality of transmitted fluid supply piping-valve systems, a plurality of transmitted fluid outlet piping-valve systems, and at least one flow ratio controller;

each of the fluid delivery inner containers being interconnected with one of the material storage containers through one of the transmitted fluid supply piping-valve systems;

each of the fluid delivery inner containers being interconnected with one of the flow ratio controllers through one of the transmitted fluid outlet piping-valve systems; and each of the transmitted fluid outlet piping-valve systems being interconnected with the transmitted fluid receiver through at least one of the flow ratio controllers.

* * * * *